United States Patent [19]

Wiedehage et al.

[11] Patent Number: 5,071,180

[45] Date of Patent: Dec. 10, 1991

[54] ARRESTING DEVICE FOR A HINGED COMPONENT

[75] Inventors: Horst Wiedehage, Mannheim; Peter Christ, Bensheim, both of Fed. Rep. of Germany

[73] Assignee: Deere & Company, Moline, Ill.

[21] Appl. No.: 500,654

[22] Filed: Mar. 27, 1990

[30] Foreign Application Priority Data

Apr. 7, 1989 [DE] Fed. Rep. of Germany ..... 3911319

[51] Int. Cl.[5] ..... E05F 3/00

[52] U.S. Cl. ..... 292/268; 292/DIG. 4; 267/64.12; 217/60 D

[58] Field of Search ..... 292/338, 267, 268, DIG. 4, 292/DIG. 43, DIG. 3, 262; 217/60 D; 262/64.12

[56] References Cited

U.S. PATENT DOCUMENTS

| | | | |
|---|---|---|---|
| 1,281,060 | 10/1918 | Nicol | 217/60 D |
| 1,281,061 | 10/1918 | Nicol | 217/60 D |
| 1,776,198 | 9/1930 | Russ et al. | 217/60 D |
| 2,550,008 | 4/1951 | Freeman | 292/268 |
| 2,684,169 | 7/1954 | Elerdine | 217/60 D |
| 3,785,004 | 1/1974 | Stoffregen | 292/DIG. 4 |
| 4,078,779 | 3/1978 | Mölders | 292/268 |
| 4,194,264 | 3/1980 | Stoffregen | 292/DIG. 4 |
| 4,790,580 | 12/1988 | Casilio | 292/DIG. 4 |
| 4,811,983 | 3/1989 | Watts et al. | 267/64.12 |

FOREIGN PATENT DOCUMENTS

| | | |
|---|---|---|
| 0284890 | 3/1988 | European Pat. Off. . |
| 2335136 | 7/1977 | France . |

*Primary Examiner*—Eric K. Nicholson

[57] ABSTRACT

An arresting device for a hinged component such as a window or roof hatch of a motor vehicle has a peg mounted to a first member, which in turn is pivotally mounted to the hinged component or to the frame for the hinged component. A guide rail is pivotally mounted to the other one of the frame or the hinged component and has a slot in which the peg slides. A gate is slidably mounted to the guide rail and also has a slot in which the peg slides. The slots in the guide rail and the gate each have at least one recess formed in their sides which are selectively alignable such that the peg can move into the aligned recesses. At least the recess on the guide rail has a notch formed at one end to positively hold the peg. Preferably, the gate and/or guide rail are spring biased so that the peg will move into the recesses when they are aligned. When the recesses are not aligned, the side of the slot on the gate covers the recess on the guide rail, and vice-versa, preventing the peg from moving into the recesses. The guide rail, gate and their respective slots are sized such that the recesses will align when one end of the slots are aligned, but will not align when the other end of the slots are aligned. Opening and closing of the hinged component will move the peg to engage the ends of the gate slot to push it into or out of alignment. Thus, no direct manipulation of the arresting mechanism is required to move the recesses into and out of alignment.

11 Claims, 3 Drawing Sheets

ARRESTING DEVICE FOR A HINGED COMPONENT

BACKGROUND OF THE INVENTION

1. Field of the Invention

The present invention concerns an arresting device for a hinged component that can pivot about an axis, and in particular a window or roof hatch for a vehicle that can be swung out to at least one position.

2. Description of the Related Art

Hinged components that can be moved to various positions, such as windows or roof hatches, are widely used in motor vehicles. In such use, the hinged components typically are retained so that they will not swing to an undesired position due to shocks or wind force due to vehicle motion.

Bringing such a hinged component to a new position and arresting it there normally requires the use of both hands. One hand grasps a handgrip to swing the hinged component, while the other hand operates a retaining mechanism. This method of operation is cumbersome and uncomfortable, especially if the hinged component or its retaining mechanism is not very accessible.

DE-OS 26 16 237 teaches a roof hatch for a utility vehicle whose hatch cover can be arrested at various open positions. A bracket with several rest position recesses is attached to the hatch cover. A peg of an arresting lever retained in the roof cutout then engages these recesses. The peg is biased in the direction of the recess by an M-shaped leaf spring. This should make possible a reliable detent engagement for the peg, and with it the hatch cover, so that the desired position is retained despite any shock.

However, the configuration of the bracket in the frame of the hatch cover is relatively costly to manufacture. In addition, the resistance of the spring must be overcome during opening and closing of the hatch cover. This arresting arrangement also does not offer an assured retention under extreme conditions.

SUMMARY OF THE INVENTION

The object of the present invention is to provide an arresting device which is easy to manufacture, simple to operate and which will reliably arrest the position of a hinged component at pre-set positions despite shock and vibration.

This object is achieved by providing an arresting device according to the present invention between the hinged component and a frame or other receptacle. The arresting device includes a first member which is pivotally mounted at one end to the frame and which carries a peg. A guide rail with a slot in an approximately lengthwise direction is pivotally mounted to the hinged component and has the peg slidably inserted in its slot. A gate with a similar lengthwise slot is slidably mounted over the guide rail, with the peg slidably inserted in its slot. A ring on the outer end of the peg prevents the guide rail and the gate from falling off of the peg.

The slot in the guide rail has at least one recess formed on one side partway along its length. One side of the recess is sloped, while the other side forms a notch for holding the peg. The gate has at least one similarly shaped recess formed on the same side of its slot, though the notch may be omitted from the gate recess.

The lengths of the guide rail and the gate, and the positions of the slots and recesses in them, are such that when the upper ends of the slots are aligned, the corresponding recesses are aligned, but when the lower ends of the slots are aligned, the side of the slot in the gate covers the recess in the guide rail (and vice-versa). This prevents the peg from moving into the recesses unless the slots are properly aligned.

Opening the hinged component will cause the peg to slide along the slots, until it reaches a recess. If the recesses are aligned, the peg will slide into them and make contact with the notch in the guide rail recess, holding the hinged component in this position. This represents a positive locking connection, which is effected solely by the swinging of the hinged component, and which can be achieved merely by moving the handgrip attached to the hinged component with one hand. Positive locking here is preferred over friction locking, since it can be applied automatically without further measures (use of a second hand), and it assures reliable retention despite strong vibration, shock and wind force due to vehicle motion.

If, on the other hand, the recesses are not aligned, the peg will continue sliding along the slots, until it reaches an uncovered recess or the end of the slot in the gate. If it reaches the end of the slot in the gate, it will push the gate along the guide rail until it reaches the end of the guide rail slot. At that point, the recesses will be aligned. If the hinged component then is moved back towards its closed position, the peg eventually will reach the aligned recesses and move into them.

The arresting device according to this invention can be produced at low cost with simple sheet metal stampings, and occupies very little space. It can be located in an area inaccessible to the operator, since no direct operation of the mechanism is necessary. This arresting device is particularly appropriate when applied to front or rear windows or to roof hatches which must be retained in various positions in vehicles, particularly utility vehicles such as agricultural or industrial tractors.

Ordinarily the guide rail can be arranged in such a way that it will swing under the influence of its own weight upon reaching the arresting position, so that the peg will engage the recesses that are in alignment. However, if desired, this swinging movement can be aided (or effected completely, if gravity is not helpful), by a spring, preferably a torsion spring.

The recesses preferably are configured asymmetrically, with one flank inclined backwards and the other running out at a slant. The flank inclined backward forms a notch to engage the peg in the arresting position, and prevents the guide rail from swinging out of the arresting position and the hinged component from further movement (such as opening). If the arresting position is to be designed so that further opening of the hinged component is to be prevented by positive locking, the flank inclined backward will be on the side of the recess opposite the pivot of the guide rail.

In order to avoid undesirable movement of the gate along the guide rail, the gate preferably should be movable only after overcoming frictional forces. Spring clips can be attached to the gate for this purpose that are in elastic contact with the guide rail and which provide a frictional engagement.

According to a preferred embodiment of the invention at least one power source that supplies swinging force is provided between the hinged component and the receptacle, which forces the peg against the backward sloping flank of the recess in the arresting position. The power source may, for example, be a hydraulic or mechanical spring, such as a hydraulic cylinder or a gas pressurized spring. The latter is a low-cost commercial component.

The power source can be connected to produce a swinging movement of the hinged component towards or away from the receptacle, depending on the application. In the case of roof hatches it is appropriate to utilize the force for opening. Here the backward inclination of the flank of the recess prevents further opening from the arresting position under the force of the power source. It is preferred that the arresting device and the power source be arranged approximately in parallel and configured as a single assembly that is easily installed. An arrangement that is particularly appropriate locates the guide rail parallel to a gas pressurized spring, whose gas pressure is used to provide the force for the opening of the hinged component.

The force of the power source should be sufficient to rotate the hinged component to its maximum position, including acting against the weight of the hinged component. At its maximum position, the hinged component should be reliably retained against shock and wind force. It therefore is advantageous if the force provided by the power source is 1.7 times the minimum force that would be required to retain the hinged component in its maximum position. At the same time, the force of the power source should not be too great to be overcome by hand, as needed to rotate the hinged component.

Instead of the use of a power source, in some cases gravity may be used to pre-load the hinged component in the direction of an open position.

BRIEF DESCRIPTION OF THE DRAWINGS

The present invention will be described in greater detail with reference to the following figures.

DETAILED DESCRIPTION OF THE PREFERRED EMBODIMENTS

Figure 1:
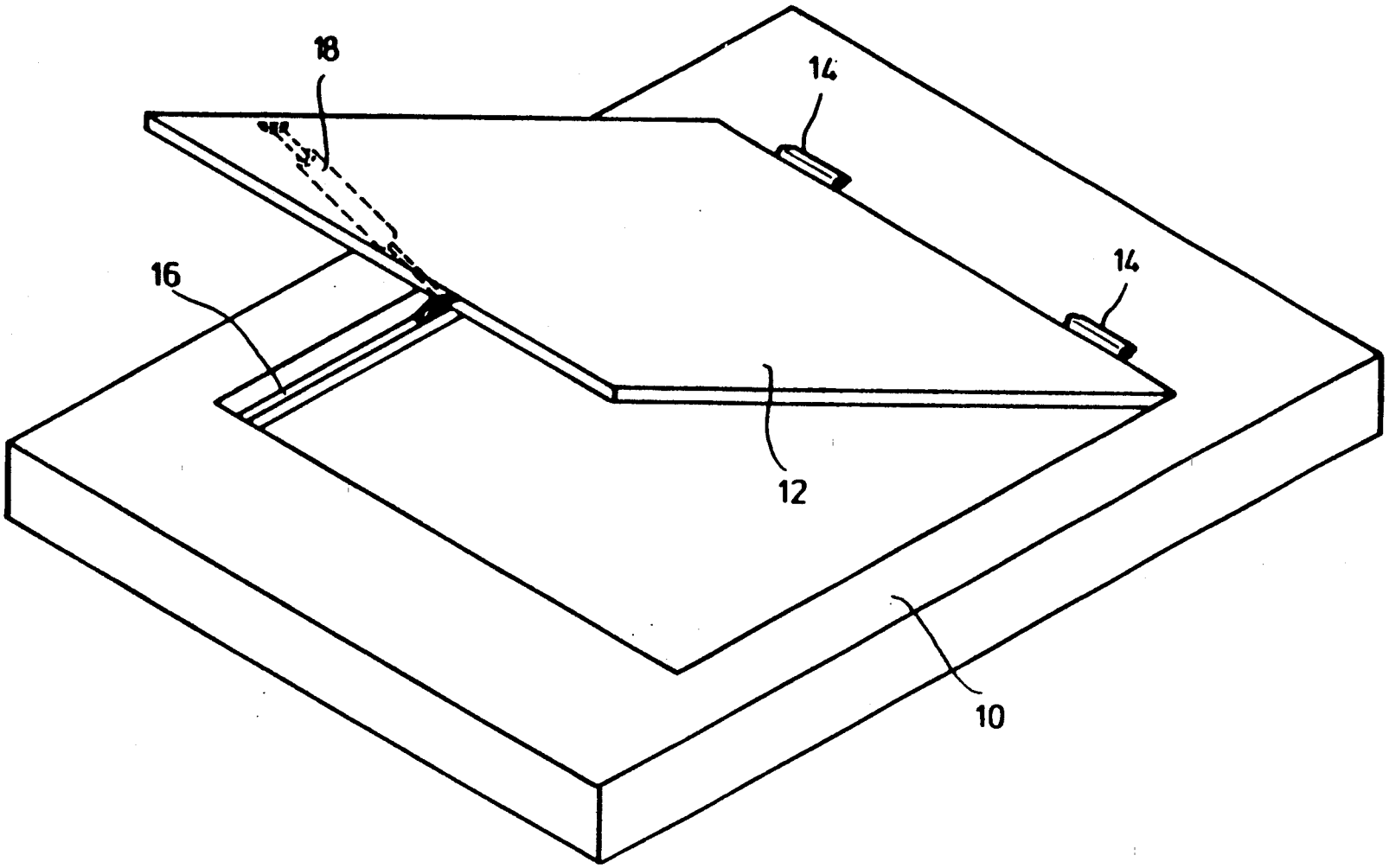
FIG. 1 shows a schematic perspective of the roof hatch of an agricultural tractor and an arresting device according to the present invention.

FIG. 1 shows a portion of the roof 10 of an agricultural tractor in which a roof hatch 12 is installed. The roof hatch 12 is shown opened half way. It can be swung about an axis, formed by two hinges 14, with respect to the frame 16, which is configured as a receptacle for the roof hatch 12 and is fixed to the roof 10. The usual sealing components are integrated into the frame 16 to assure a rainproof enclosure.

The roof hatch 12 can be opened and closed from the inside by grasping a handgrip (not visible in the figure) on the inner surface of the hatch 12 with one hand and moving it in a substantially vertical direction. The arresting device 18 according to the invention is indicated between the frame 16 and the frame of the roof hatch 12, which is not shown in detail. If required, a second arresting device may be attached to the opposite side of the roof hatch 12, parallel to this arresting device 18.

Figure 2:
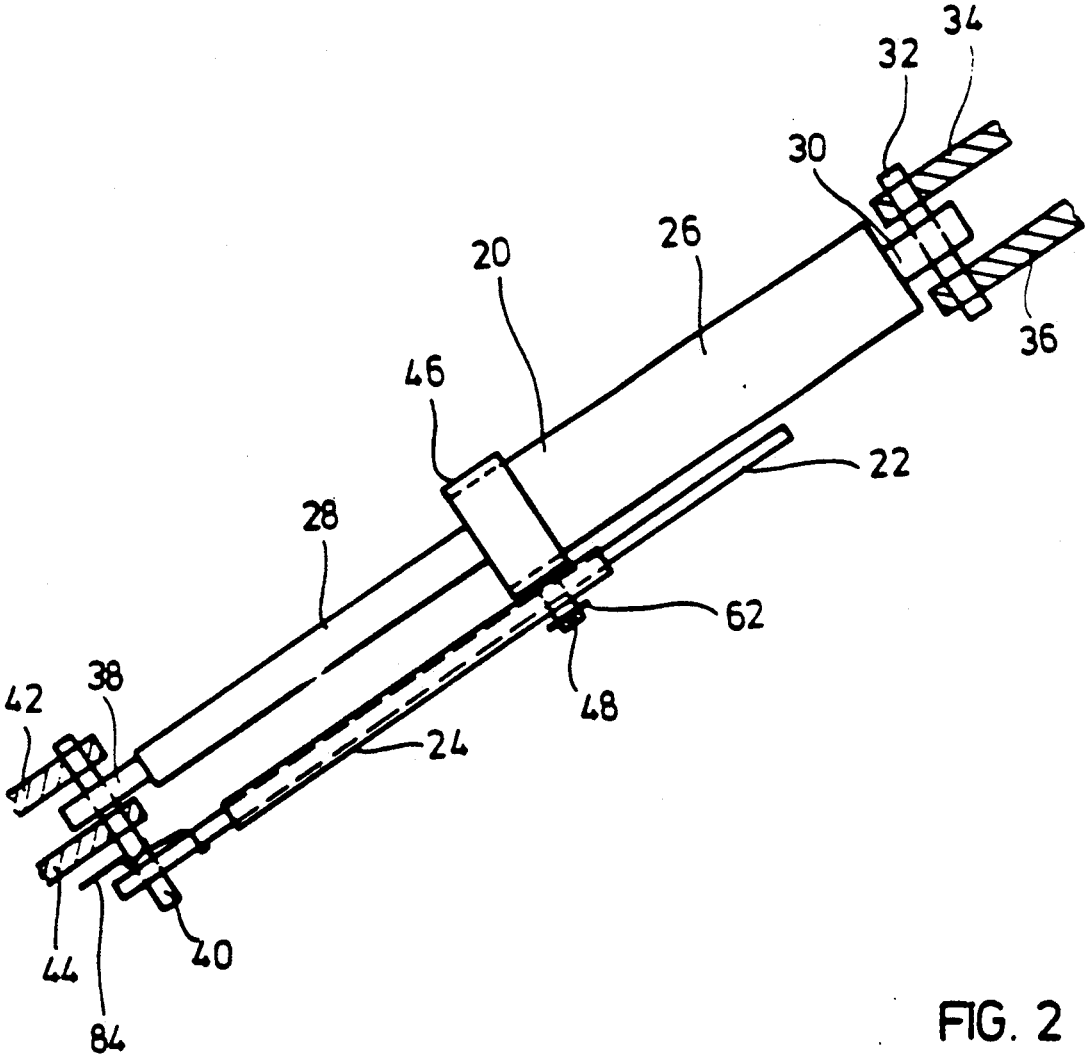
FIG. 2 shows the arresting device according to the invention with a gas pressurized spring cylinder as a complete assembly.

The arresting device 18 is shown in greater detail in FIG. 2. It consists generally of a gas pressurized spring 20, a guide rail 22, and a gate 24. The guide rail 22 and the gate 24 are shown in greater detail in FIGS. 3 through 6.

As shown in FIG. 2, the gas pressurized spring 20 includes a gas pressure cylinder 26 and a piston rod 28. The free end of the gas pressure cylinder 26 carries a bracket 30, which is pivotally mounted by a pin 32 to two brackets 34, 36 attached to the frame of the roof hatch 12. The free end of the piston rod 28 also carries a bracket 38 that is pivotally mounted by a pin 40 to two brackets 42, 44 that are attached to the frame 16 on the roof 10. The gas pressurized spring 20 is pre-loaded in such away that it tends to force the piston rod 28 out of the gas pressure cylinder 26. It thus generates an upward force that will open roof hatch 12 when it is not arrested or hold it in an open position when it is arrested. Preferably, the spring force of the gas pressurized spring 20 is chosen so that it at least 1.7 times minimum force required to open the roof hatch 12.

Figure 5:
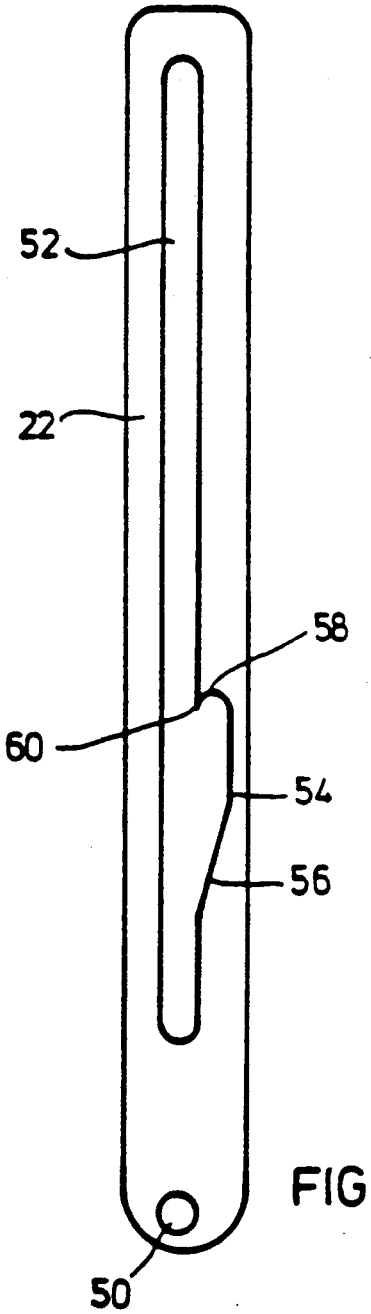
FIGS. 5 and 6 show a side view and a front view of the guide rail according to the present invention.
Figure 6:
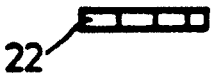

A ring 46 is attached to the outer surface of the gas pressure cylinder 26, at the end towards the piston rod 28. The ring 46 carries a peg 48 directed radially outward. A guide rail 22 is arranged between the peg 48 and the hinge pin 40. As shown in FIGS. 5 and 6, the guide rail 22 is a generally flat metal strip which has a hole 50 at one end. A longitudinal slot 52 extends over almost the entire length of the guide rail 22. When assembled, the pin 40 engages the hole 50 and the peg 48 engages the slot 52, so that the guide rail 22 can pivot about the pin 40 and the peg 48 can slide in the slot 52. Upon opening and closing of the roof hatch 12 the peg 48 slides along the slot 52 of the guide rail 22. A retaining ring 62 (shown in FIG. 2) is attached to the outer end of the peg 48 to assure that the guide rail 22 does not slide off the peg 48.

The slot 52 is provided with a recess 54 on one side (the generally upper side when positioned as shown in FIG. 1). The recess 54 is asymmetrical in shape. The flank 56 of the recess 54 towards the hole 50 is arranged so that the recess 54 runs out at a slant into the slot 52. The opposite flank 58 of the recess 54 is angled backwards to form a projecting nose 60 between the recess 54 and slot 52, so that the flank 58 and nose 60 together form a notch to retain the peg 48.

Figure 3:
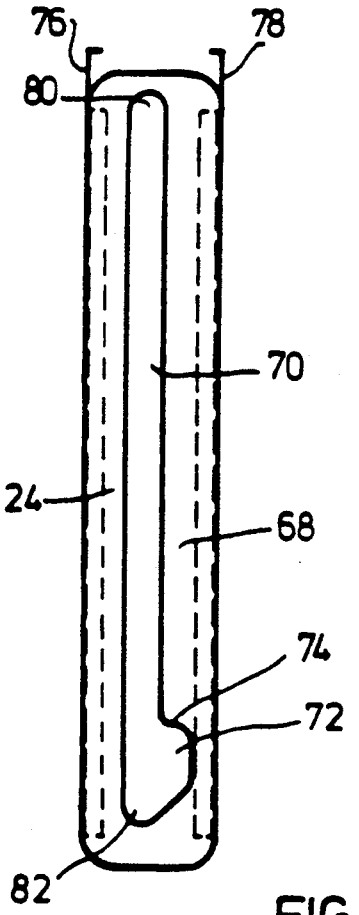
FIGS. 3 and 4 show a side view and a front view of the a gate according to the present invention.
Figure 4:
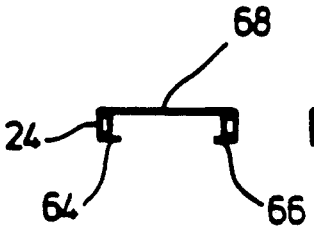

FIGS. 3 and 4 show the gate 24. This is a formed sheet-metal part, whose cross section is generally C-shaped, as shown in FIG. 4. The gate 24 slides longitudinally along the guide rail 22, with the two free legs 64, 66 surrounding the guide rail 22. The base part 68 of the gate 24 contains a slot 70 extending generally over its entire length. This slot 70 corresponds to the slot 52 of the guide rail 22, although it is not quite as long. At one end of the gate 24 the slot 70 widens into a recess 72. The recess 72 is similar to the recess 54 in the guide rail 22, with regard to its width and its steep flank 74, although in the case of the gate 24 the nose 60 can be eliminated. Two spring clips 76, 78 are located at the end of the gate 24 opposite the recess 72. In the assembled condition these spring clips 76, 78 are in contact, under spring tension, with the side face of the guide rail 22 and provide friction locking between the two components 22, 24. This friction locking prevents movement of the gate 24 under its own weight along the guide rail 22. Movement will occur only when the peg 48 reaches one of the ends of the slot 80, 82 and overruns.

In the assembled condition of the arresting device 18, the recesses 54, 72 are located on the generally upper side of the guide rail 22 and the gate 24 (when the device is positioned as shown in FIG. 1). If recesses 54, 72 are aligned when the peg 48 reaches them, the guide rail 22 will swing downward due to its own weight and due to torsion spring 84, which is wound around the pin 40 as pivot, and makes contact at one end with the frame 16 and at the other end with the guide rail 22 (see FIG. 2). The peg 48 then will slide into the recesses 54, 72.

OPERATION

The operation of the arresting device according to the present invention is as follows:

Upon opening the roof hatch 12 the gas pressurized spring 20 extends fully, since initially the recess 54 of the guide rail 22 is covered by the base 68 of the gate 24. In the last phase of the opening movement, the peg 48 will reach the end 80 of the slot, so that upon further opening the gate 24 is pushed along the guide rail 22 towards the guide rail's free end. When the peg 48 reaches the ends 52, 80 of the slots in both the guide rail 22 and the gate 24, the two recesses 54, 72 will be in alignment. If a fully opened hatch is desired, the roof hatch 12 can simply be left in this position.

To move to an intermediate position, the roof hatch 12 is moved downwards. As it does, the gate 24 will remain in its extreme position relative to the guide rail 22 due to the friction force of the spring clips 76, 78. When the peg 48 reaches the now aligned recesses 54, 72 during a closing movement, the guide rail 22 will swing downward under the force of gravity and of the torsion spring 84, so that the peg 48 will slide into the recesses 54, 72. If in this position the closing operation is stopped and the roof hatch 12 released, the gas pressurized spring 20 will move the roof hatch 12 back towards an open position. However, this movement will be interrupted as soon as the peg 48 has reached the notch formed by the flank 58 and nose 60. Opening of the roof hatch 12 beyond this stop is now impossible. Thus, the roof hatch 12 is arrested in this intermediate position, held open by the force of the gas pressurized spring 20. Closing is possible only after overcoming the force of the gas pressurized spring.

If the roof hatch 12 is closed from its intermediate, arrested position, the peg 48 will reach the lower end 82 of the slot in the gate 24, so that upon further closing the gate 24 will be pushed along the guide rail 22 towards the pivot 40. With the gate 24 in this position, the recess 54 again will be covered by the base 68 of the gate 24, whereupon the initial position is again reached.

Accordingly the arresting position can be reached only when the roof hatch 12 is first opened completely, and then brought back to the partially opened arresting position. From this arrested position the roof hatch 12 can no longer be opened further, and can only be closed after overcoming the force of the gas pressurized spring 20. Since the arresting mechanism does not need to be operated directly during opening and closing of the roof hatch 12, it can be placed at a location not accessible to the operator, if desired.

Various modifications to the present invention can be made to the described embodiment. The invention has been described with reference to a roof hatch, but can be used with any other hinged component. The slots in the guide rail and gate can be provided with multiple alignable recesses if it is desired to be able to arrest the hinged component in a variety of positions. Depending on circumstances of use, it also may be desirable to reverse the direction in which the gas pressurized spring presses, so that it pulls the hinged component closed rather than pushes it open. If so, the directions of the slopes of the recesses also should be reversed. For an appropriately positioned hinged component, it may be possible to substitute a simple rod for the gas pressurized spring, allowing gravity to provide the activating force.

While the invention has been described in conjunction with a specific embodiment, it is to be understood that many alternatives, modifications and variations will be apparent to those skilled in the art in light of the aforegoing description. Accordingly, this invention is intended to embrace all such alternatives, modifications and variations which fall within the spirit and scope of the appended claims.

We claim:

1. A device for arresting a hinged component in at least one arresting position relative to a frame to which the hinged component is pivotally mounted, the device comprising:

a. a first member pivotally mounted to one of the hinged component and the frame and having a peg attached thereto;

b. a guide rail pivotally mounted to the other of the hinged component and the frame and having a slot formed therein extending approximately lengthwise along said guide rail in which said peg slides, said guide rail slot having a recess formed in a side thereof into which said peg can move;

c. a gate slidably mounted to said guide rail, said gate having a slot formed therein extending approximately lengthwise along the gate and along which said peg slides, wherein said gate slot has:

two closed ends;

sides such that said gate will normally cover said guide rail recess to prevent said peg from moving into said guide rail recess; and a recess formed in a side thereof into which said peg can move when said guide rail recess and said gate recess are aligned, said recesses becoming so aligned only when said hinged component is in the at least one arresting position;

and wherein said guide rail slot is longer than said gate slot so that said peg can slide said gate along said guide rail to move said recesses into and out of alignment simply by engaging the ends of said gate slot.

2. The arresting device of claim 1, further comprising a spring to bias said guide rail against said peg such that said peg will move into said guide rail recess whenever said peg is adjacent thereto and said guide rail recess is not blocked by said gate.

3. The arresting device of claim 1, wherein said guide rail recess is configured so that one side slopes outwardly from the guide rail slot until it intersects another side which is sloped in a similar direction but at a greater angle, the two sides together forming a notch into which said peg can fit and be held against further motion along the slot.

4. The arresting device of claim 3, wherein the notch side of said guide rail recess is on the side of said recess away from said other one of said hinged component and said frame.

5. The arresting device of claim 1, further comprising frictional engagement means for preventing said gate from sliding along said guide rail due to its own weight.

6. The arresting device of claim 5, wherein said frictional engagement means comprises at least one elastic bracket formed on said gate directed generally lengthwise along said guide rail and in elastic, frictional contact with said guide rail.

7. The arresting device of claim 1, further comprising at least one power source for pressing said peg towards an end of said guide rail recess.

8. The arresting device of claim 7, wherein the force of said power source is sufficient to swing the hinged component to its maximum pivoted position and to retain it reliably in this position.

9. The arresting device of claim 7, wherein said power source comprises a gas pressurized spring whose cylinder and piston rod are each pivotally mounted to one of said hinged component or frame.

10. The arresting device of claim 9, wherein the cylinder of said gas pressurized spring serves as said first member.

11. The arresting device of claim 1, further comprising a second guide rail recess formed in the side of said guide rail slot, and wherein said device has a second arresting position and said gate normally prevents said peg from entering said second guide rail recess unless said second guide rail recess is aligned with said gate recess, said recesses becoming so aligned only when said hinged component is in said second arresting position.

* * * * *